United States Patent [19]

Sweet

[11] 4,047,352

[45] Sept. 13, 1977

[54] BRIDGING CLIP FOR TRUSS JOISTS

[76] Inventor: Lavern E. Sweet, 6561 Arthur St., Chino, Calif. 91710

[21] Appl. No.: 714,560

[22] Filed: Aug. 16, 1976

[51] Int. Cl.[2] ..... E04C 3/02

[52] U.S. Cl. ..... 52/693; 52/712

[58] Field of Search ..... 52/693, 697, 643, 721, 52/712, 665, 488; 403/392, 394, 400, 405, 406

[56] References Cited

U.S. PATENT DOCUMENTS

| | | | |
|---|---|---|---|
| 3,229,440 | 1/1966 | Troutner | 52/693 |
| 3,256,030 | 6/1966 | Bouse | 52/712 X |
| 3,299,593 | 1/1967 | Auila | 52/712 X |
| 3,744,206 | 7/1973 | Nelson et al. | 52/721 X |

*Primary Examiner*—Price C. Faw, Jr.
*Assistant Examiner*—Carl D. Friedman
*Attorney, Agent, or Firm*—Knobbe, Martens, Olson, Hubbard & Bear

[57] ABSTRACT

An improved bridging clip is disclosed for securing bridging members to composite truss joists having metal cross bracing and wooden chords.

3 Claims, 4 Drawing Figures

BRIDGING CLIP FOR TRUSS JOISTS

BACKGROUND OF THE INVENTION

This invention relates to truss joists of the type which are a composite of wooden top and bottom chords, usually 2 × 4's, held together by pinned metal diagonal struts assembled in a zig-zag configuration as disclosed in the Troutner, U.S. Pat. No. 3,137,899 for a Composite Truss.

Composite truss joists of this type are utilized in the construction of roofs and ceilings spanning large distances between supporting walls and are considered to be a conventional method for construction of this type. When a plurality of lateral truss joists are placed in parallel alignment along two bearing walls, longitudinal bridging members are required between the truss joists to secure the lower chord members of said truss joists in vertical plumb alignment and for hanging ceilings panels or other loads therefrom. Various methods for installing and securing the longitudinal bridging members have been devised. One example of art of attaching bridging members to truss joists is the Troutner, U.S. Pat. No. 3,229,440, Bridging Clip for Trussjoist. This Troutner patent discloses a bridging clip comprised of a tubular metal shank with the respective ends flattened perpendicular to each other. One end has a hole for the cross pin which permits its assembly with the diagonal web members. The opposite end is nailed to the bridging member. Since this clip is preassembled with the cross web members in the main truss joist, a wider slot must be cut in the lower chord member, thus weakening the structure. No tolerance for misalignment of the longitudinal bridging members is provided. Securing the bridging member to the clip preassembled within truss joist is difficult since no means for supporting the bridging member during the attachment operation is provided. Another disadvantage is the minimal space within the truss joist construction for tool manipulation, since the longitudinal bridging members must be installed after the lateral truss joists are fixed to the bearing walls.

In the prior art, the bridging clip attaches to only one side of the bridge thereby applying an eccentric load on the bridge tending to make the bridge unstable. This must be compensated for by special braces if a stable, maximum strength structure is to result.

The present invention alleviates many of the disadvantages associated with the prior art and specifically to those of fabrication, assembly, and attachment of connectors or clips.

SUMMARY OF THE INVENTION

The preferred embodiment of the invention described herein comprises a flat metal strap formed into a basic V-configuration with the ends of the Vee perforated with a plurality of holes to permit attachment of the bridging clip to the longitudinal bridging member by means of stud nails or bolts.

A particular object of the invention is to provide a bridging clip which can be easily attached to the structural members after said members have been placed in the proper aligned position in the construction of a roof/ceiling. Projecting spurs in the channel section of the clip lock it in place during the attachment operation.

These and other advantages of the present invention are best understood through a reference to the drawings, in which.

Figure 1:
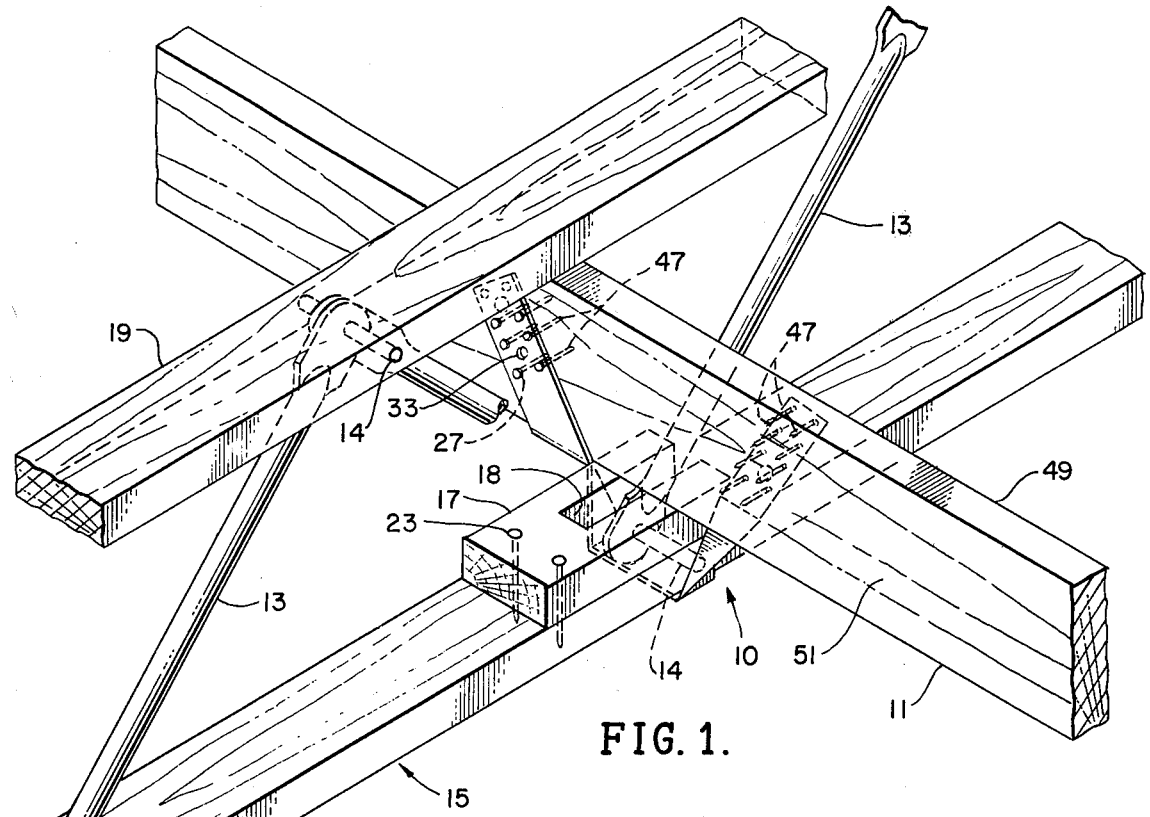
FIG. 1 is a fragmentary perspective view of a truss joist, partially broken away for clarity of illustration, showing the bridging clip attached to a longitudinal bridging member.

Referring initially to FIG. 1, a bridging clip 10 is shown attached to a longitudinal bridging member 11, which may be either a wooden 2 × 4 or a 2 × 6 as illustrated. The bridging member 11 is inserted between the metal struts 13 of the composite truss joist 15. The longitudinal bridging member 11 is raised by means of a slotted shim block 17 to clear the interference of the Vee formed by the adjoining metal web struts 13 which are anchored by pins 14 between the upper and lower chords 19 and 21 respectively of the truss joist 15. The shim block 17 is slotted at 18 to permit it to straddle the connected ends of web struts 13 in the routed slots 20 in the lower chord 21. The shim block 17 is of appropriate thickness to shim up the bridging member 11 to a horizontal level clearing the Vee of the adjoining struts 13. This type of simple shimming allows the longitudinal alignment of the bridging members 11 as they pass through the web struts 13 of a series of truss joists 15 in a roof construction. When properly positioned, the shim block 17 is secured to the lower chord 21 of truss joist 15 by nails 23. The method of attaching the bridging clip 10 to the truss joist 15 and bridging member 11 will be described heretofor.

Figure 2:
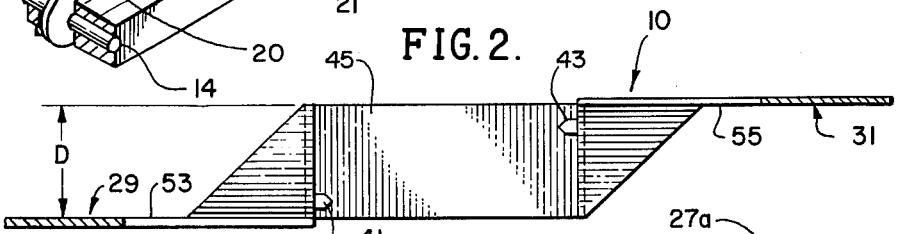
FIG. 2 is a top elevation view with the ends of the bridging clip partially broken away.
Figure 3:
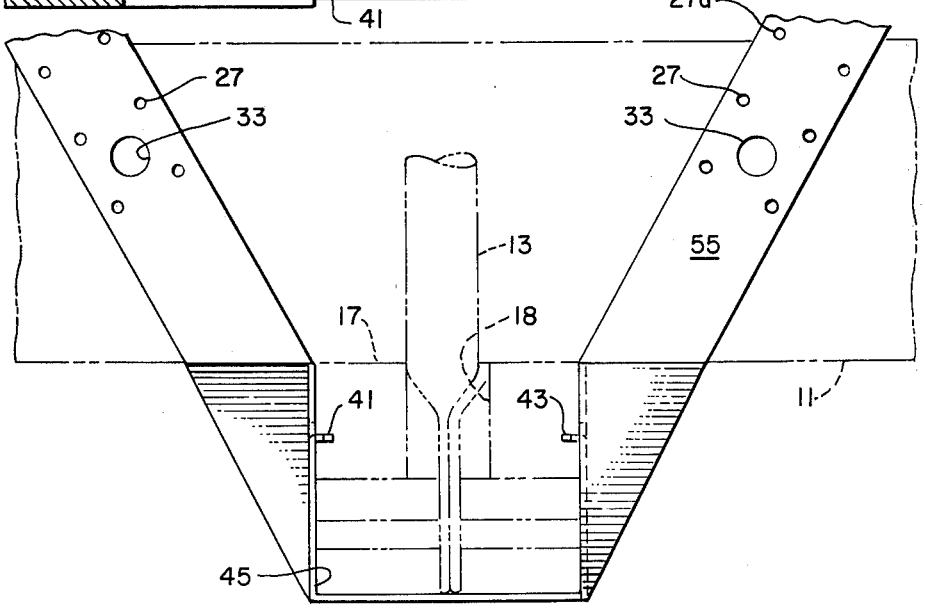
FIG. 3 is a front elevation view.
Figure 4:
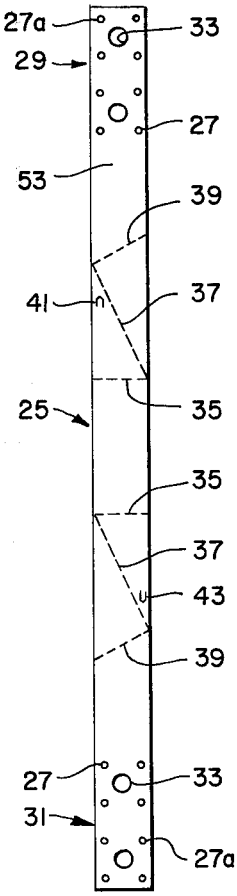
FIG. 4 is a plan view of the flat metal strap before bending into the configuration as shown in FIGS. 1, 2 and 3.

Referring now to FIGS. 2, 3 and 4, a bridging clip 10 is shown in detail. A bridging clip blank 25 prior to forming comprising a flat strap of 16 or 19 gauge metal, 28 inches in length and 1½ inches in width is shown in FIG. 4. A plurality of nail holes 27 are drilled or punched in the ends 29 and 31 of the blank 25. Fold lines 35, 37 and 39 are shown as dotted lines on the blank 25. When the metal blank 25 is bent along fold lines 35, 37 and 39, it will assume the configuration as shown in FIGS. 2 and 3 to form the clip 20. Short spurs 41 and 43 are punched out inwardly from that portion of the blank 25 as bordered by fold lines 35 and 37. The spurs 41 and 43 clinch the shim block 17 in the assembly of the clip 10 to the bridging member 11. The ends 29 and 31 of the blank 25 when bent into its functional configuration as shown in FIG. 1, 2 and 3 straddle the bridging member 11 on opposite sides at a 60° included angle as best shown in FIGS. 1 and 2. The central channel portion 45 of the formed clip 10 as best shown in FIG. 3 straddles the lower chord 21 of the truss joist 15 thereby securing the longitudinal bridging member 11 tightly against the lateral chord 21 through the shim 17. Short stud nails 47 are used to secure the ends 29 and 31 of the clip 10 to the side surfaces 49 and 51 of the bridging member 11. The combined angles of the fold lines 37 and 39 result in the offset parallel positioning of the inner surfaces 53 and 55 of the ends 29 and 31 of the blank 25 after it has been folded. The distance D between the parallel surfaces 53, 55 is equal to the thickness of the bridging member 11, thereby facilitating the attachment of the ends 29, 31 of the clip 10 to the opposite sides 49 and 51 respectively. The innermost set of nail holes 27 of the clip 10 are utilized when the bridging member is a 2 × 4. The outer set of holes **27*a*** are used in conjunction with a 2 × 6 bridging member. The larger holes 33 are utilized when the clip is attached with bolts.

Referring to FIG. 1, it will be apparent that the surfaces 53 and 55 will be symmetrically disposed on opposite sides of the bridge and when secured thereto will eliminate any eccentricity which would otherwise be present and which is inherent in the bridging clips of the prior art. This provides greater stability and structural strength to the inner connection between the truss joist and the bridge and to the overall structure.

In summary, an improved bridging clip has been developed which finds application to a truss roof system connecting the longitudinal bridging members to the lateral truss joists and meets the building specifications of the O.A.C. (Office of Architecture and Construction). A truss system utilizing the bridging clip as described herein will carry greater loads since no modifications are required to the basic metal web truss joist for adaption of said bridging clip. This improved load distribution factor of the basic truss system will be gained by the elimination of the need for widening the web strut slots in the lower chord member of the truss joist to accept the bridging clip which weakens that member of the composite truss joist assembly. An additional advantage is gained from the utilization of the bridging clips disclosed in this application by enabling concentrated loads to be hung from any position in the truss system. Such suspension of concentrated load factors from the bottom (ceiling) of the truss system or the placement of dead load factors on the top (roof) of the truss system are distributed throughout the tension/-compression members in the assembly by means of the bridging members securely attached to the lower chord members of the truss joist.

Thus, a truss joist bridging system is disclosed wherein the connector elements can be attached after the erection of the system, the attachment of the connector elements requires no modification to the basic truss components, and the attachment of the connector elements requires a minimum number of nails, screws, or bolts.

A connector element is disclosed which comprises a bridging clip formed from a flat metal strap into a configuration which will permit the attachment of a longitudinal building construction member to a crossing lateral bridging member. The bridging clip is formed from said flat metal strap into a generally V-configuration with attachment means provided at the extremities of the V extensions. The attachment means may comprise a plurality of nail, screw, and bolt holes spaced in such manner as to permit attachment of the bridging clip to either 2 × 4 or 2 × 6 longitudinal truss bridging members. The valley of the "V" is shaped into a squared "U" channel to straddle a lateral 2 × 4 or 4 × 4 truss chord member, and includes projecting spurs on the inner surfaces of the squared U channel to lock said bridging clip to the lateral truss chord member.

In structural terms, the bridging clip comprises a longitudinal strap of sheet metal, or any equivalent material, folded so as to form a centrally disposed channel having a bottom strap extending across a chord of a truss joist, the two adjacent portions of the strap extending perpendicularly to the bottom strap upwardly along the vertical edges of the chord and, in the preferred embodiment, upwardly along the vertical edges of a shim block and having opposed spurs which are adapted to be driven into the shim block, the vertical portions having oppositely angled fold lines so disposed that the vertical portions are folded outwardly along the respective angled fold lines such that the upper ends of the strap extend upwardly from the bottom strap and diverge outwardly from each other and are displaced so that the ends lie in parallel planes a distance D apart, the distance D approximating the thickness of the bridging member, the ends of the strap being adapted to being secured to opposite sides of the bridging member by stud nails, bolts, spurs formed in the strap material or by other fastening means, whereby the bridging member is securely fastened to the truss joist above and perpendicularly to the truss joist chord for positioning the chord relative to other truss joist chords, transmitting loading between adjacent truss joists, and maintaining bridged truss joists in relatively parallel relationship.

Many variations in dimensions, thicknesses and materials can be made without departing from the concept and scope of the invention, of which only an exemplary embodiment has been illustrated and described in detail. For example, the weight of the strap material and the placement of the folds and bends therein can be varied within the scope of the invention as described and claimed herein to accommodate the same to light duty or heavy duty truss joists constructed of 2 × 4's, or even lighter lumber, or heavy duty truss joists constructed of 4 × 6's or other heavy timbers or laminated or paired timber structures. Fastening means of various kinds can be used to provide structurally sound fastening. Material selection, as well as the shown factors, are all within the scope of the invention, as defined in the following claims.

What is claimed is:

1. In a truss joist construction comprising a plurality of truss joists in generally parallel relationship, a bridging member extending generally perpendicular to the truss joists and means securing the bridging member to the truss joists, the improvement wherein the securing means comprises:

a longitudinal strap folded so as to form a generally V-configuration having centrally disposed channel which includes a bottom strap extending across the bottom of the chord of a truss joist, two adjacent portions of the strap extending perpendicularly to the bottom strap upwardly along the vertical edges of the chord, the vertical portions having oppositely angled fold lines so disposed that the vertical portions are folded outwardly along the respective angled fold lines such that the upper ends of the strap extend upwardly from the bottom strap and diverge outwardly from each other and are displaced so that the ends lie in parallel planes a distance D apart, the distance D approximating the thickness of the bridging member, the ends of the strap being secured to the bridging member whereby the bridging member is securely fastened above and perpendicularly to the chord for positioning the chord relative to other truss joist chords, transmitting loading between adjacent truss joists, and maintaining bridged truss joists in relatively parallel relationship.

2. In the system of claim 1, the improved bridging clip which includes spurs formed therein for being driven into wooden structural members for fastening the bridging clip thereto.

3. For use in constructing a truss joist system which includes a plurality of truss joists in generally parallel relationship, a bridging member securing the bottom chords of the truss joists together and being secured to the bottom chords by means of a bridging clip, the improved bridging clip which comprises:

a longitudinal strap of sheet metal folded so as to form a generally V shaped structure having a centrally disposed channel which includes a bottom strap extending across the bottom of a chord of a truss joist, two adjacent portions of the strap extending perpendicularly to the bottom strap upwardly along the vertical edges of the chord, the vertical portions having oppositely angled fold lines so disposed that the vertical portions are folded outwardly along the respective angled fold lines such that the upper ends of the strap extend upwardly from the bottom strap and diverge outwardly from each other and are displaced so that the ends lie in parallel planes a distance D apart, the distance D approximating the thickness of the bridging member, the ends of the strap being adapted to being secured to opposite sides of the bridging member, whereby the bridging member when securely fastened to the truss joist above and perpendicularly to the truss joist chord for positions the chord relative to other truss joist chords, transmits loading between adjacent truss joists, and maintains bridged truss joists in relatively parallel relationship.

* * * * *